US006113518A

United States Patent [19]

Maresh et al.

[11] Patent Number: 6,113,518

[45] Date of Patent: Sep. 5, 2000

[54] EXERCISE METHODS AND APPARATUS WITH FLEXIBLE ROCKER LINK

[76] Inventors: Joseph D. Maresh, P.O. Box 645, West Linn, Oreg. 97068-0645; Kenneth W. Stearns, P.O. Box 55912, Houston, Tex. 77055

[21] Appl. No.: 09/064,392

[22] Filed: Apr. 22, 1998

Related U.S. Application Data

[60] Provisional application No. 60/044,960, Apr. 26, 1997.

[51] Int. Cl.[7] ..... A63B 22/12; A63B 22/00

[52] U.S. Cl. ..... 482/52; 482/51

[58] Field of Search ..... 482/51, 52, 53, 482/57, 70, 79, 80; D21/191

[56] References Cited

U.S. PATENT DOCUMENTS

| | | | |
|---|---|---|---|
| D. 390,628 | 2/1998 | Husted | D21/191 |
| 5,279,529 | 1/1994 | Eschenbach | 482/57 |
| 5,611,756 | 3/1997 | Miller | 482/52 |
| 5,792,029 | 8/1998 | Gordon | 482/52 |
| 5,857,940 | 1/1999 | Husted | 482/51 |
| 5,910,072 | 6/1999 | Rawls et al. | 482/51 |
| 5,938,568 | 8/1999 | Maresh et al. | 482/57 |

*Primary Examiner*—Stephen R. Crow

[57] ABSTRACT

An exercise apparatus has a linkage assembly which links rotation of a crank to generally elliptical movement of a force receiving member. The linkage assembly includes a flexible rocker link interconnected between the force receiving member and the frame.

20 Claims, 9 Drawing Sheets

EXERCISE METHODS AND APPARATUS WITH FLEXIBLE ROCKER LINK

CROSS-REFERENCE TO RELATED APPLICATION

This application discloses subject matter entitled to the earlier filing date of Provisional Application No. 60/044,960, filed on Apr. 26, 1997.

FIELD OF THE INVENTION

The present invention relates to exercise methods and apparatus and specifically, to exercise equipment which facilitates exercise through an adjustable curved path of motion.

BACKGROUND OF THE INVENTION

Exercise equipment has been designed to facilitate a variety of exercise motions. For example, treadmills allow a person to walk or run in place; stepper machines allow a person to climb in place; bicycle machines allow a person to pedal in place; and other machines allow a person to skate and/or stride in place. Yet another type of exercise equipment has been designed to facilitate relatively more complicated exercise motions and/or to better simulate real life activity. Such equipment typically links a relatively simple motion, such as circular, to a relatively more complex motion, such as elliptical. Although advances have been made in this particular field, significant room for improvement remains, with regard to the variability of exercise motion and/or the simplicity of design, for example.

SUMMARY OF THE INVENTION

The present invention provides methods and apparatus to link relatively simple, circular motion of a crank to relatively more complex, generally elliptical motion of a foot supporting member. More specifically, by introducing a flexible rocker link between the foot supporting member and the frame, the present invention facilitates a variety of design options and/or exercise motion characteristics heretofore unavailable to the exercise equipment industry. The features and advantages of the present invention may become more apparent from the detailed description that follows.

BRIEF DESCRIPTION OF THE DRAWING

With reference to the Figures of the Drawing, wherein like numerals represent like parts throughout the several views.

DETAILED DESCRIPTION OF THE PREFERRED EMBODIMENT

Generally speaking, the present invention provides exercise methods and apparatus which link rotation of left and right cranks to generally elliptical motion of respective force receiving members. The term "elliptical motion" is intended in a broad sense to describe a closed path of motion having a relatively longer first axis and a relatively shorter second axis (which is perpendicular to the first axis). Although such motion and motion generating linkage assemblies are described with reference to a front end and a rear end, those skilled in the art will recognize that the present invention is not limited to any particular orientation of the user.

All of the depicted embodiments of the present invention are generally symmetrical about a vertical plane extending lengthwise through a floor engaging base, the primary exception being the relative orientation of certain parts on opposite sides of the plane of symmetry. Typically, the "right-hand" parts are one hundred and eighty degrees out of phase relative to the "left-hand" counter-parts. When reference is made to one or more parts on only one side of the apparatus, it is to be understood that corresponding part(s) are disposed on the opposite side of the apparatus. Those skilled in the art will also recognize that the portions of the frame which are intersected by the plane of symmetry exist individually and thus, do not have any "opposite side" counterparts.

Figure 1:
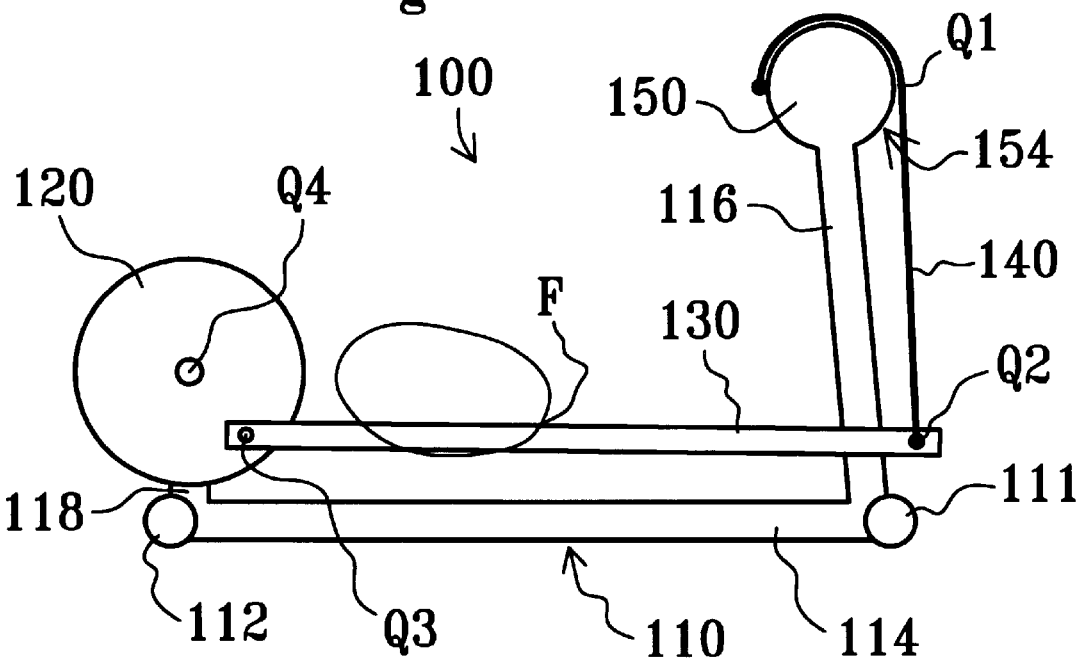
FIG. 1 is a side view of a first exercise apparatus constructed according to the principles of the present invention.

A first exercise apparatus constructed according to the principles of the present invention is designated as 100 in FIG. 1. The apparatus 100 includes a frame 110 having an I-shaped base 114 which extends from a first or forward end 111 to a second or rearward end 112 and is designed to rest upon a horizontal floor surface. A first stanchion or upright portion 116 extends upward from the base 114 proximate the forward end 111. A second stanchion or upright portion 118 extends upward from the base 114 proximate the rearward end 112.

On each side of the apparatus 100, a crank 120 is rotatably mounted to the rear stanchion 118 via a common shaft. In particular, each crank 120 includes a respective flywheel which is rigidly secured to the crank shaft and rotates together therewith relative to the frame 110. A drag strap may be disposed in tension about a circumferential groove on one or both flywheels to resist rotation thereof relative to the frame 110. Those skilled in the art will recognize that other forms of resistance means may be added to or substituted for the drag strap without departing from the scope of the present invention. Those skilled in the art will also recognize that the flywheels may be described simply as members which rotate about the crank axis relative to the frame 110, and further, that the flywheels may be replaced by pulleys or crank arms, for example, which may or may not in turn by connected to a flywheel.

On each side of the apparatus 100, a rear end of each force receiving member 130 is rotatably connected to a respective crank 120; an intermediate portion of each force receiving member 130 is sized and configured to support a respective foot of a standing person; and a front end of each force receiving member 130 is rotatably connected to a respective rocker link 140. Each force receiving member 130 may also be described as a rigid foot supporting link rotatably interconnected between a respective crank 120 and a respective rocker link 140.

Each rocker link 140 is a flexible member, such as a cable, for example, which is suspended relative to the forward stanchion 116. More specifically, an upper end of each flexible rocker link 140 is secured to a bearing member or drum 150 which is rigidly mounted on top of the stanchion 116. An intermediate portion of each flexible rocker link 140 extends across a bearing surface 154 on the bearing member 150. The lower end of each flexible rocker link 140 is connected to a respective foot supporting link 130.

The bearing surface 154 and the flexible link 140 cooperate to define a first pivot axis Q1 at their point of separation from one another. The flexible link 140 and the foot supporting link 130 cooperate to define a second pivot axis Q2 which moves perpendicular to the portion of the flexible link 140 extending between the pivot axis Q1 and the pivot axis Q2. The foot supporting link 130 cooperates with the crank 120 to define a third pivot axis Q3 which rotates about the crank axis Q4. The center of a person's foot F and underlying foot supporting link 130 move through the generally elliptical path shown in FIG. 1.

Figure 2:
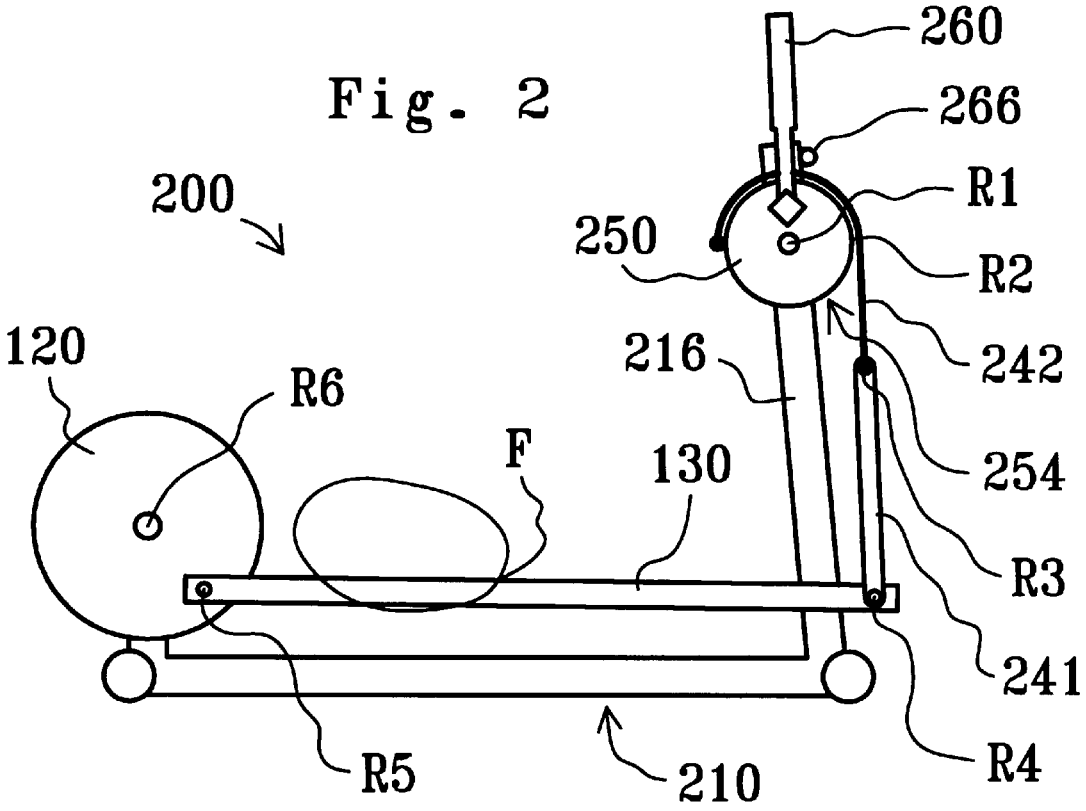
FIG. 2 is a side view of a second exercise apparatus constructed according to the principles of the present invention.

A second embodiment of the present invention is designated as 200 in FIG. 2. The apparatus 200 includes a similar frame 210 and identical cranks 120 and foot supporting members 130. The forward end of each foot supporting member 130 is rotatably connected to a respective rigid intermediate link 241 which in turn, is rotatably connected to a lower end of a respective flexible link 242. An opposite, upper end of each flexible link 242 is secured to a respective bearing member or drum 752 which is rotatably mounted on the forward stanchion 216. An intermediate portion of each flexible link 241 extends across a bearing surface 254 disposed on the bearing member 250

On each side of the apparatus, a handle 260 has a first end rigidly connected to a respective bearing member 250, and a second, distal end which is sized and configured for grasping. A stop 266 is rigidly secured to the stanchion 216 and extends across each of the handles 260 to limit forward rotation of the handle 260 (clockwise in FIG. 2) relative to the frame 210. Rearward rotation of the handle 260 (counter-clockwise in FIG. 2) is resisted by the weight of the person acting on the foot supporting members 130 and imposing a moment force on the bearing members 250.

The drums 250 and the frame 210 cooperate to define a first pivot axis R1. The bearing surface 254 and the flexible link 242 cooperate to define a second pivot axis R2 at their point of separation from one another. The flexible link 242 and the rigid link 241 cooperate to define a third pivot axis R3 which is the center of little, if any, relative rotation between the flexible link 242 and the rigid link 241. The rigid link 241 and the foot supporting link 130 cooperate to define a fourth pivot axis R4 which moves substantially perpendicular to the rigid link 241. The foot supporting link 130 cooperates with the crank 120 to define a fifth pivot axis R5 which rotates about the crank axis R6. Rotation of the cranks 120 is linked to movement of the person's feet F and underlying foot supporting links 130 through the generally elliptical path shown in FIG. 2. Counter-clockwise rotation of either handle 260 causes a respective foot to move through a different, more upwardly inclined path of motion.

Figure 3:
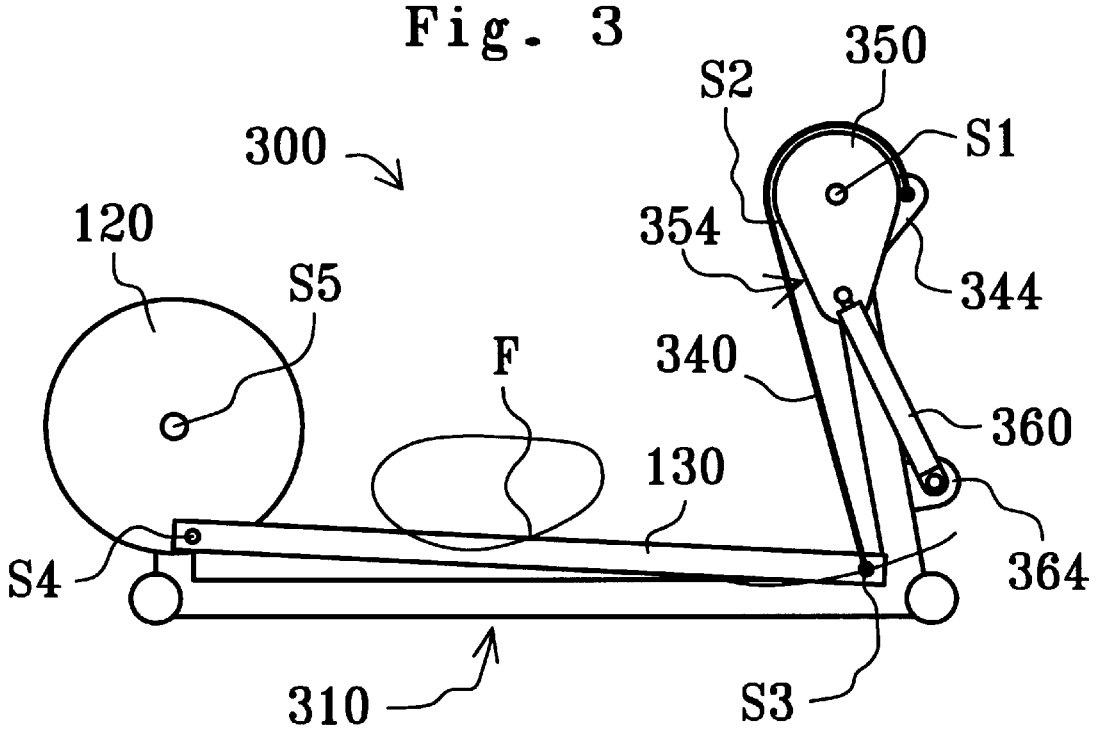
FIG. 3 is a side view of a third exercise apparatus constructed according to the principles of the present invention.
Figure 4:
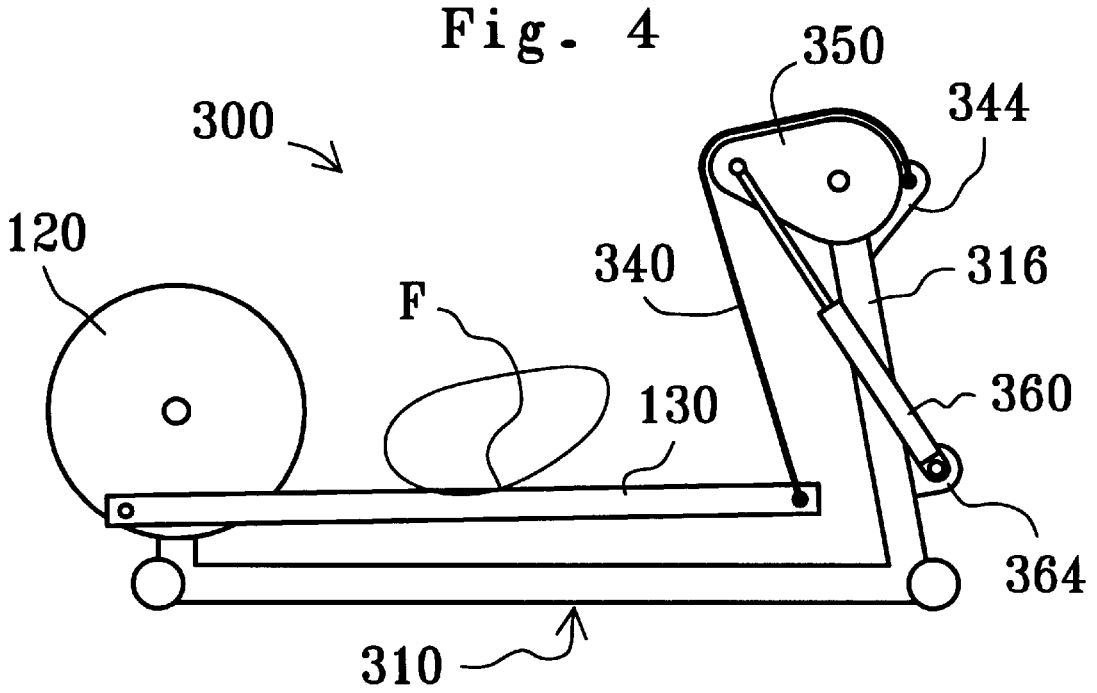
FIG. 4 is a side view of the exercise apparatus of FIG. 3 in a discrete configuration.

FIGS. 3–4 show a third exercise apparatus 300 constructed according to the principles of the present invention. The apparatus 300 includes a similar frame 310 and identical cranks 120 and foot supporting members 130. The forward end of each foot supporting member 130 is rotatably connected to a lower end of a respective flexible rocker link 340. An opposite, upper end of each flexible rocker link 340 is secured to a flange 344 on the forward stanchion 316 of the frame 310. Bearing members 350 are rotatably mounted on the forward stanchion 316, and an intermediate portion of each flexible rocker link 340 extends across a bearing surface 354 disposed on a respective bearing member 350.

The bearing members 350 and the frame 310 cooperate to define a first pivot axis S1. The bearing surface 354 and the flexible rocker link 340 cooperate to define a second pivot axis S2 at their point of separation from one another. The flexible rocker link 340 and the foot supporting link 130 cooperate to define a third pivot axis S3 which moves substantially perpendicular to the portion of the flexible rocker link 340 extending between the pivot axis S2 and the pivot axis S3. The foot supporting link 130 cooperates with the crank 120 to define a fourth pivot axis S4 which rotates about the crank axis S5.

The bearing members 350 are keyed to a common shaft and rotate together relative to the stanchion 316. A linear actuator 360 is rotatably interconnected between one of the bearing members 350 and a trunnion 364 on the forward stanchion 316. The bearing members 350 are asymmetrically shaped or cammed in such a manner that rotation thereof relative to the forward stanchion 316 places discrete portions of the bearing surfaces 354 into engagement with the flexible rocker links 340. When the bearing members 350 occupy the orientation shown in FIG. 3, rotation of the cranks 120 is linked to movement of the person's feet F and underlying foot supporting links 130 through the generally elliptical path shown in FIG. 3. As shown in FIG. 4, clockwise rotation of the bearing members 350 causes the person's feet F to move through a different, more upwardly inclined path of motion. The linear actuator 360 may be operated by a programmed controller and/or at the discretion of the user to vary exercise motion.

Figure 5:
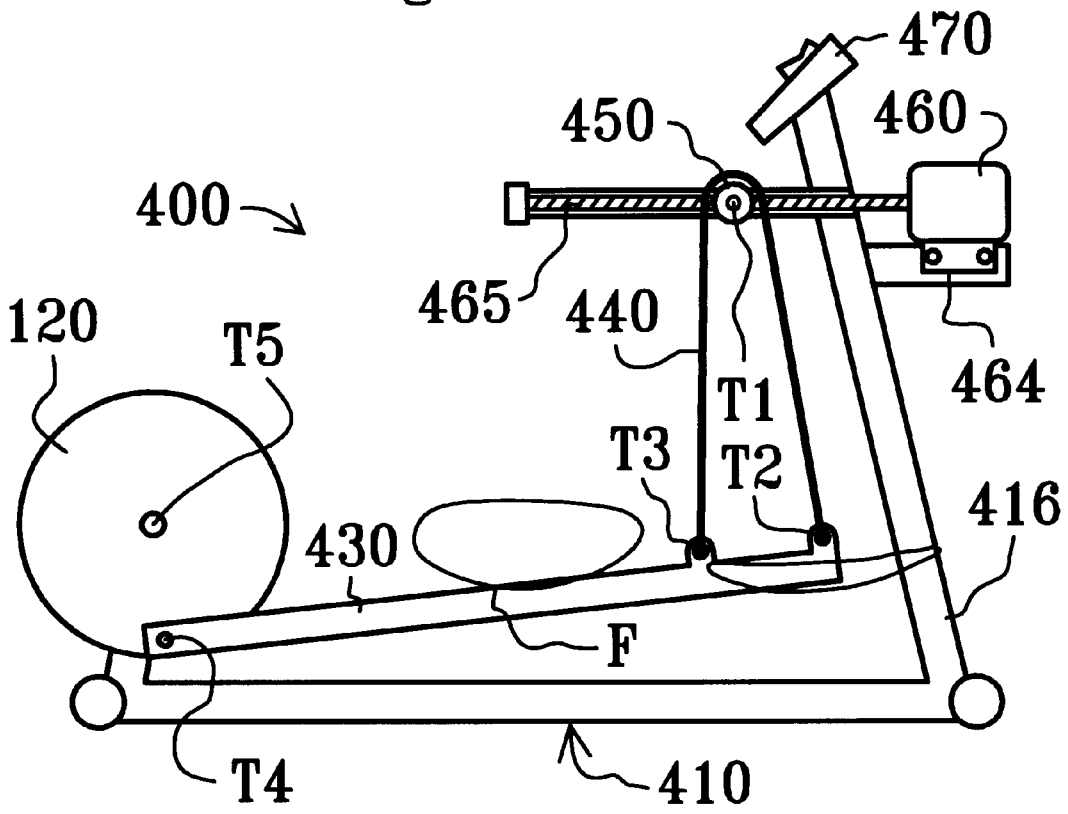
FIG. 5 is a side view of a fourth exercise apparatus constructed according to the principles of the present invention.
Figure 6:
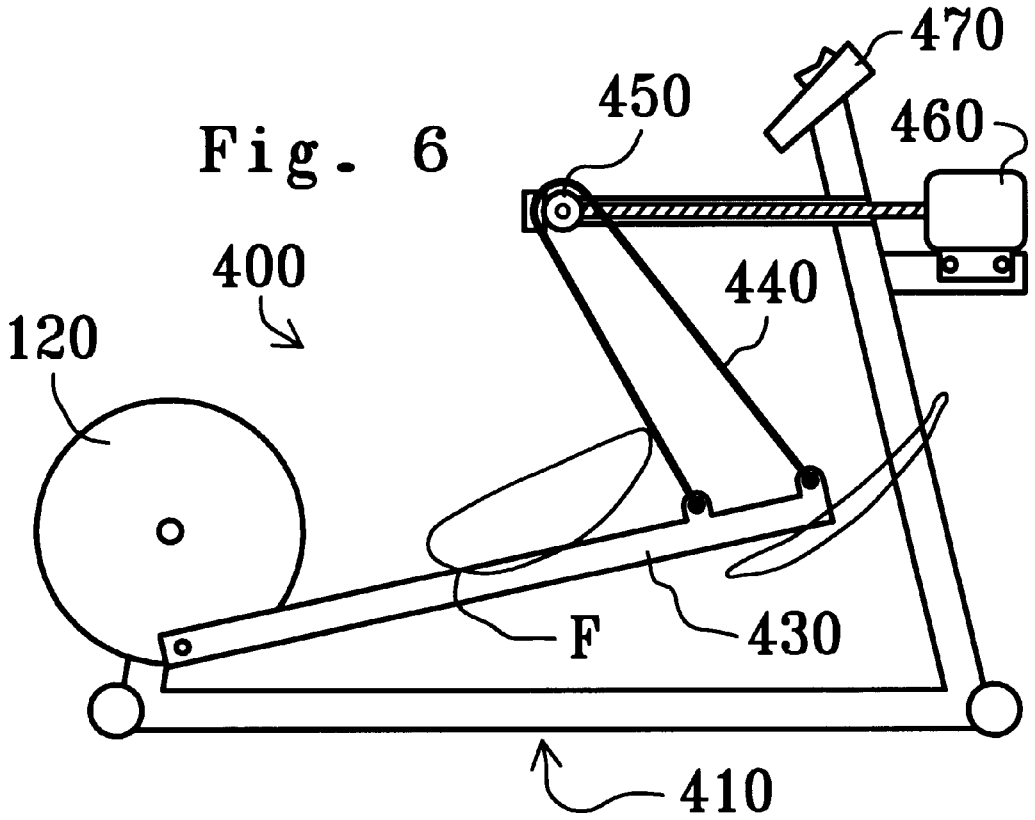
FIG. 6 is a side view of the exercise apparatus of FIG. 5 in a discrete configuration.
Figure 7:
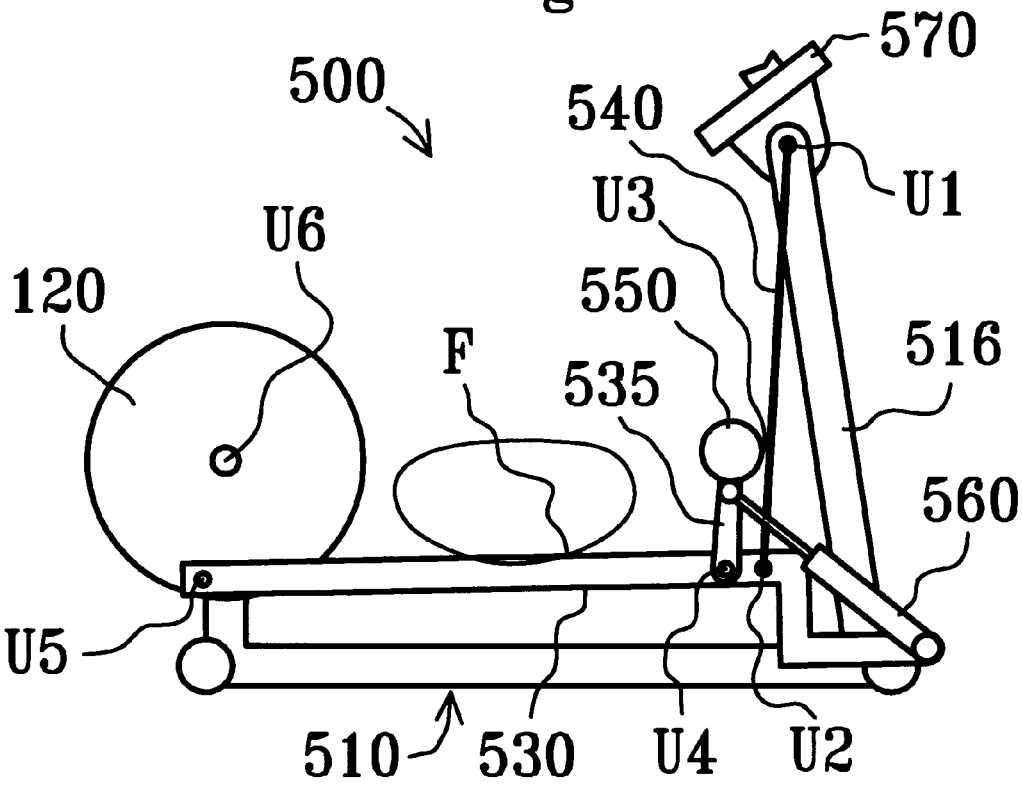
FIG. 7 is a side view of a fifth exercise apparatus constructed according to the principles of the present invention.
Figure 8:
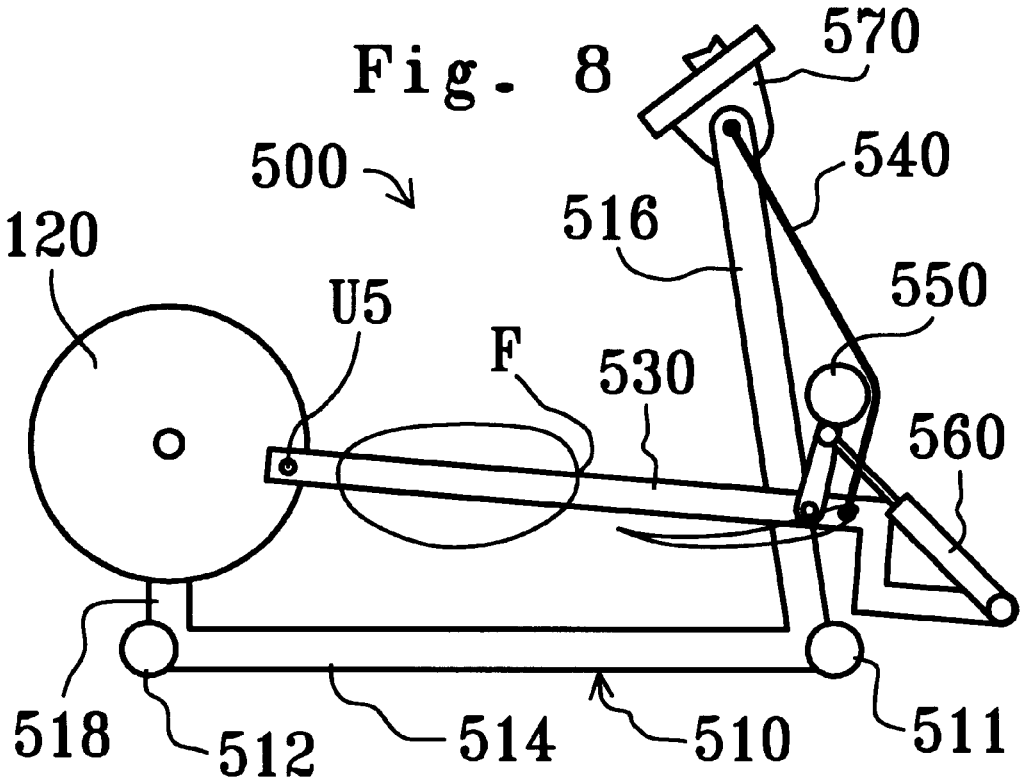
FIG. 8 is a side view of the exercise apparatus of FIG. 7 in a discrete portion of an exercise cycle.

A fourth embodiment of the present invention is designated as 400 in FIGS. 5–6. The apparatus 400 includes identical cranks 120 and a frame 410 and foot supporting members 430 similar to those on preceding embodiments. The forward end of each foot supporting member 430 is rotatably connected to opposite ends of a respective flexible rocker link 440. An intermediate portion of each flexible rocker link 440 is disposed about a pulley 450 supported by the forward stanchion 416 on the frame 410.

The pulley 450 is selectively movable forward and backward along a worm gear 465. A motor 460 is mounted on the forward stanchion 416 by means of a bracket 464 and is operable to rotate the worm gear 465. A user interface 470 is also mounted on the forward stanchion 416 and is in communication with the motor 460. Operation of the motor 460 may be controlled by a programmed controller and/or at the discretion of the user.

The pulley 450 and the adjustment assembly (including the worm gear 465) cooperate to define a first pivot axis T1. The flexible link 440 and the foot supporting link 430 cooperate to define second and third pivot axes T2 and T3. The foot supporting link 430 cooperates with the crank 120 to define a fourth pivot axis T4 which rotates about the crank axis T5.

When the pulley 450 occupies the position shown in FIG. 5, the person's foot F and underlying foot supporting link 430 move through the generally elliptical and substantially level path shown. When the pulley 450 is moved rearward and occupies the position shown in FIG. 6, the person's foot F and underlying foot supporting link 430 move through the generally elliptical and upwardly inclined path shown.

FIGS. 7–10 show a fifth exercise apparatus 500 constructed according to the principles of the present invention. The apparatus 500 has a frame 510 which includes an I-shaped base 514 and front and rear stanchions 516 and 518 extending upward from respective ends 511 and 512 of the base 514. On each side of the apparatus 500, a crank 120 is rotatably mounted to the rear stanchion 518 via a common shaft. A rear end of each force receiving member 530 is rotatably connected to a respective crank 120. A front end of each foot supporting member 530 is rotatably connected to a lower end of a respective flexible rocker link 540. An opposite, upper end of each flexible rocker link 540 is secured to the forward stanchion 516.

On each side of the apparatus 500, an intermediate link 535 is rotatably connected to the front end of a respective force receiving member 530, just rearward of a respective flexible link 540. A distal end of each intermediate link 535 supports a respective bearing member 550. Each bearing member 550 engages an intermediate portion of a respective flexible link 540 during operation of the apparatus 500. Also, on each side of the apparatus 500, a variable length member 560 is rotatably interconnected between a respective intermediate link 535 and a forward distal end of a respective foot supporting link 530.

The flexible link 540 and the frame 510 cooperate to define a first pivot axis U1. The flexible link 540 and the foot supporting link 530 cooperate to define a second pivot axis U2. The flexible link 540 and the bearing member 550 cooperate to define a third pivot axis U3 at their point of separation. The intermediate link 535 and the foot supporting link 530 cooperate to define a fourth pivot axis U4. The foot supporting link 530 cooperates with the crank 120 to define a fifth pivot axis U5 which rotates about the crank axis U6.

Figure 9:
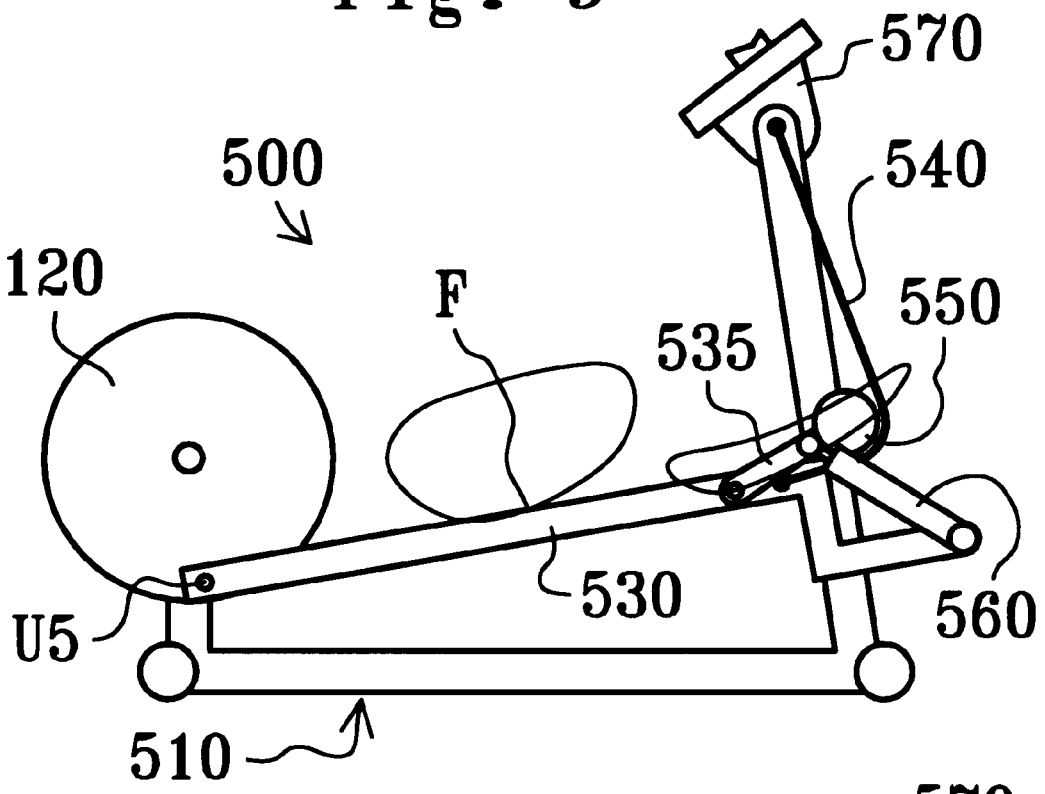
FIG. 9 is a side view of the exercise apparatus of FIG. 7 in a discrete configuration.
Figure 10:
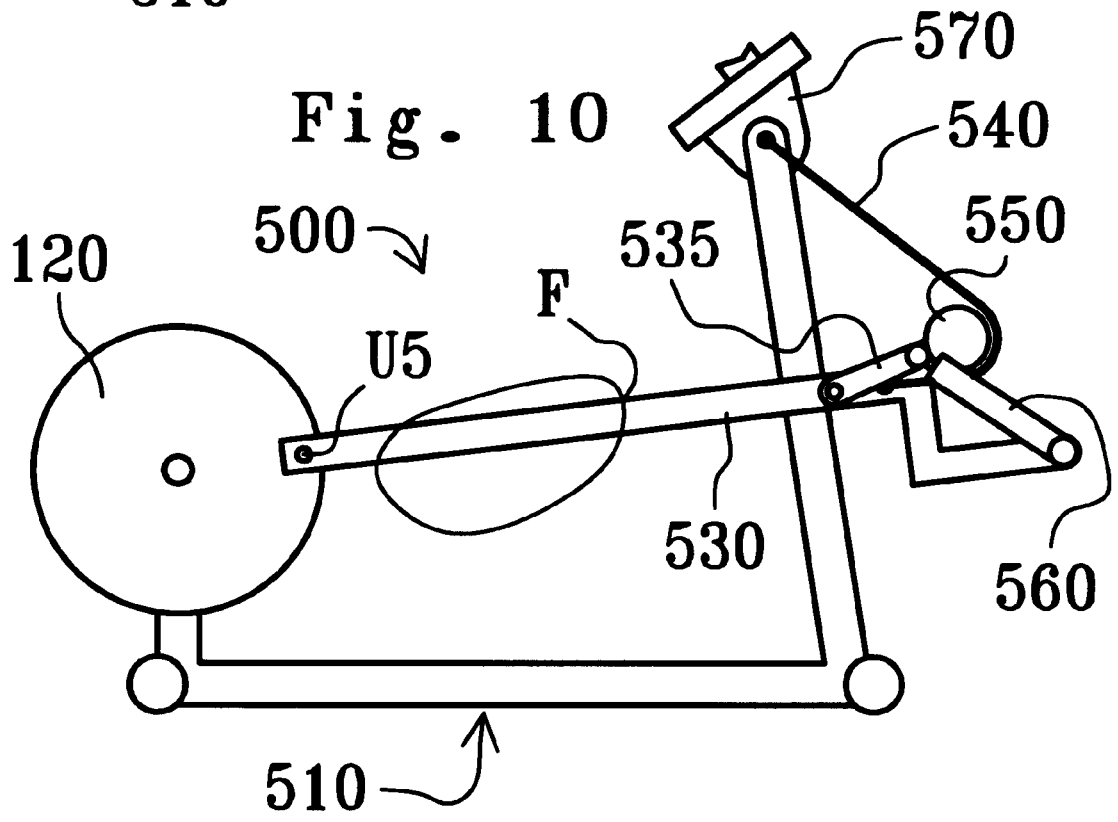
FIG. 10 is a side view of the exercise apparatus of FIG. 9 in a discrete portion of an exercise cycle.

The variable length members 560 may be linear actuators in communication with a controller and/or user interface 570 mounted on top of the front stanchion 516. The actuators 560 are operable by user input and/or a control program to vary the location of the bearing members 550 relative to the foot supporting links 530 and the flexible links 540. When the bearing members 550 occupy the position shown in FIGS. 7–8, rotation of the cranks 120 is linked to movement of the person's feet F and underlying foot supporting links 530 through the generally elliptical path shown in FIGS. 7–8, and intermediate portions of the flexible links 540 intermittently wrap partially around the bearing members 550. As shown in FIGS. 9–10, clockwise rotation of the intermediate links 535 causes the person's feet F to move through a different, more upwardly inclined path of motion, and intermediate portions of the flexible links 540 remain partially wrapped around the bearing members 550 throughout the exercise cycle.

Figure 11:
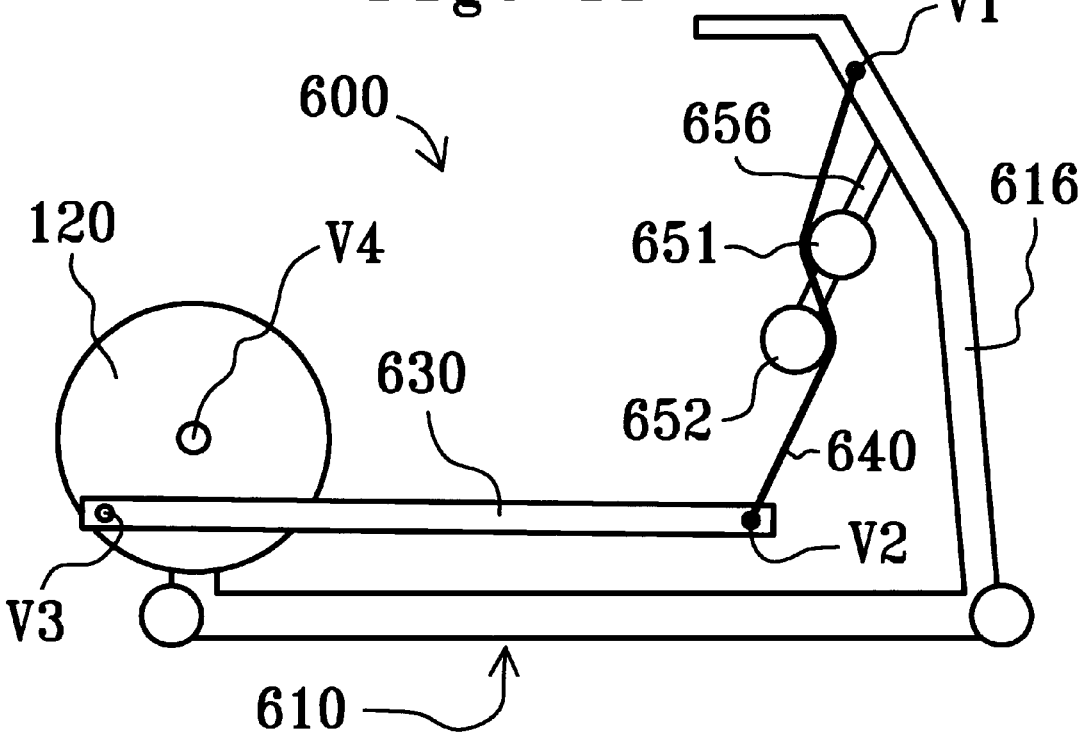
FIG. 11 is a side view of a sixth exercise apparatus constructed according to the principles of the present invention.

A sixth embodiment of the present invention is designated as 600 in FIG. 11. The exercise apparatus 600 has a frame 610 which includes an I-shaped base like all of the other embodiments. A rear stanchion extends upward from the rear end of the base and supports left and right cranks 120, which rotate together with a common shaft that is interconnected therebetween. A front stanchion 616 extends upward from the front end of the base and supports both left and right flexible rocker links 640 and a single intermediate support 656.

Left and right force receiving members 630 have rear ends that are rotatably connected to respective cranks 120, and front ends that are rotatably connected to lower ends of respective rocker links 640. Opposite, upper ends of the rocker links 640 are secured to the forward stanchion 616. An intermediate portion of each rocker link 640 is routed between first and second bearing members 651 and 652 mounted on the intermediate link 656. The bearing members 651 and 652 are arranged in such a manner that the rocker links 640 engage respective bearing members 651 throughout an exercise cycle and engage respective bearing members 652 when a respective force receiving member 630 is relatively rearward in the exercise cycle. The depicted arrangement could be modified by selectively rotating the intermediate support 656 relative to the stanchion 616, for example.

The flexible rocker 640 and the frame 610 cooperate to define a first pivot axis V1. The flexible rocker 640 and the foot supporting link 630 cooperate to define a second pivot axis V2. The flexible rocker 640 and the bearing members 651 and 652 cooperate to define a variable pivot point depending upon the location of the force receiving member 630 relative to the frame 610. The force receiving member 630 cooperates with the crank 120 to define another pivot axis V3 which rotates about the crank axis V4.

Figure 12:
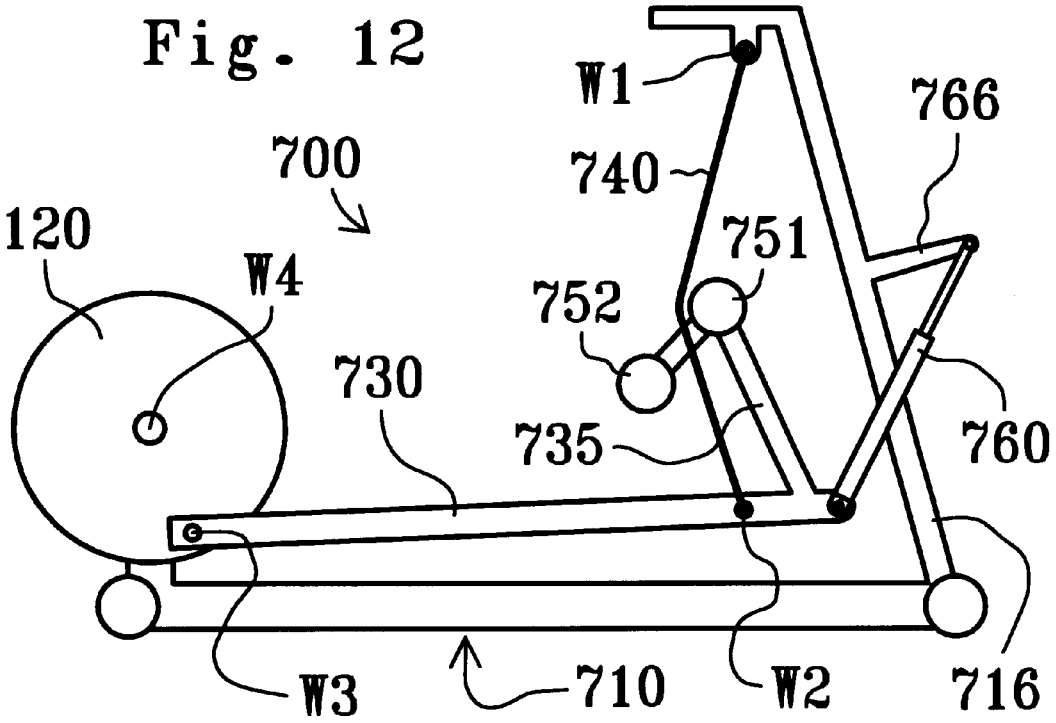
FIG. 12 is a side view of a seventh exercise apparatus constructed according to the principles of the present invention.

A seventh embodiment of the present invention is designated as 700 in FIG. 12. The exercise apparatus 700 has a frame 710 which includes an I-shaped base like all of the other embodiments. A rear stanchion extends upward from the rear end of the base and supports left and right cranks 120, which rotate together with a common shaft that is interconnected therebetween. A front stanchion 716 extends upward from the front end of the base and supports both left and right flexible rocker links 740 and a single intermediate support 766.

Left and right force receiving members 730 have rear ends that are rotatably connected to respective cranks 120, and front ends that are suspended by means of respective rocker links 740. In particular, the rocker links 740 have upper ends rotatably connected to the stanchion 716 and lower ends rotatably connected to respective force receiving members 730. Left and right linear dampers 760 are rotatably interconnected between the intermediate support 766 and the front ends of respective force receiving members 730.

Posts 735 extend generally upward from the front ends of respective force receiving members 730, between the rocker links 740 and the linear dampers 760, and support first and second bearing members 751 and 752. An intermediate portion of each rocker link 740 is routed between a respective pair of bearing members 751 and 752. The bearing members 751 and 752 are arranged in such a manner that the rocker links 740 engage respective bearing members 751 when the respective force receiving member 730 is relatively rearward, and engage respective bearing members 752 when a respective force receiving member 630 is relatively forward. The depicted arrangement could be modified by selectively rotating the posts 735 relative to respective force receiving members 730, for example.

Each flexible rocker 740 cooperates with the frame 710 to define a first pivot axis W1. Each flexible rocker 740 cooperates with a respective foot supporting link 730 to define a second pivot axis W2. Each flexible rocker 740 cooperates with a respective pair of bearing members 751 and 752 to define a variable pivot point depending upon the location of the respective force receiving member 730 relative to the frame 710. Each force receiving member 730 cooperates with a respective crank 120 to define another pivot axis W3 which rotates about the crank axis W4.

Figure 13:
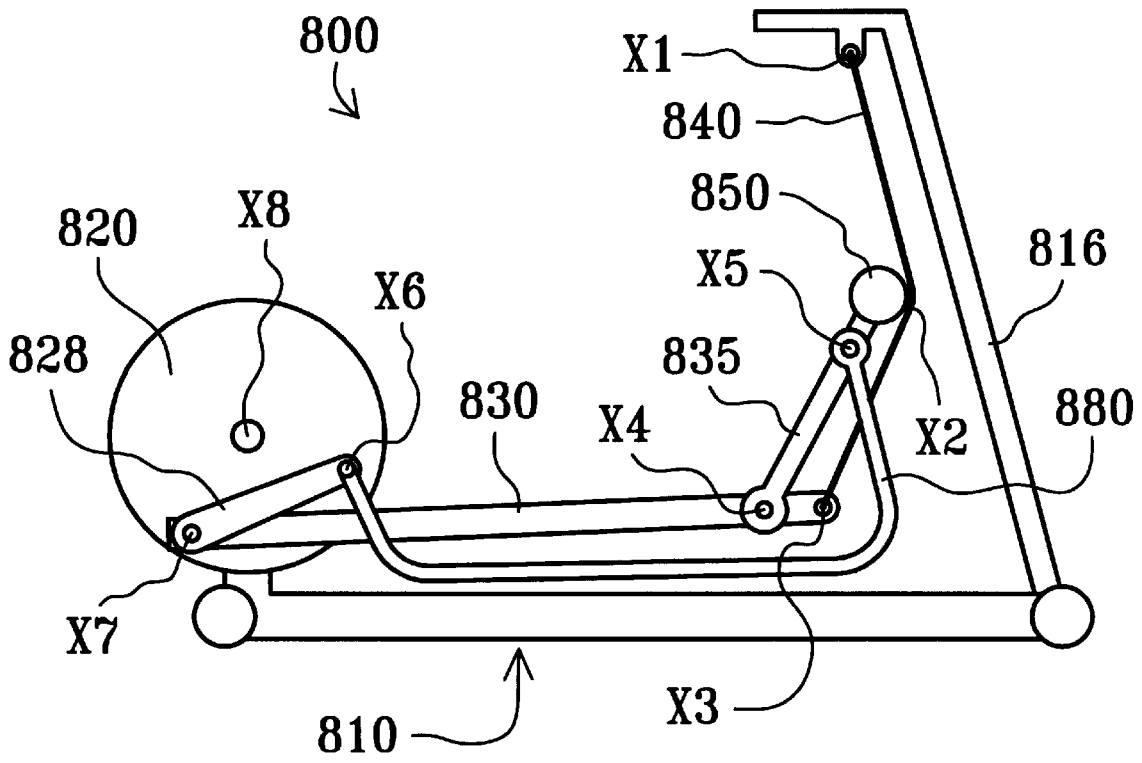
FIG. 13 is a side view of an eighth exercise apparatus constructed according to the principles of the present invention.

An eighth embodiment of the present invention is designated as 800 in FIG. 13. The exercise apparatus 800 has a frame 810 which includes an I-shaped base designed to rest upon a floor surface. A rear stanchion extends upward from the rear end of the base and supports left and right cranks 820, which rotate together with a common shaft that is interconnected therebetween. A front stanchion 816 extends upward from the front end of the base and supports left and right flexible rocker links 840.

Left and right foot supporting members 830 have rear ends that are rotatably connected to respective cranks 820, and front ends that are suspended by means of respective rocker links 840. In particular, the rocker links 840 have upper ends rotatably connected to the stanchion 816 and lower ends rotatably connected to respective foot supporting members 830. Left and right intermediate links 835 have lower ends which are rotatably mounted to respective foot supporting members 830, proximate the front ends thereof, and upper distal ends which support respective bearing members 850.

Left and right drawbar links 880 have rear ends rotatably connected to respective crank offsets 828, and front ends rotatably connected to respective intermediate links 835 between the opposite ends thereof. The drawbar links 880 cause respective bearing members 850 to pivot toward and away intermediate portions of respective rocker links 840 in response to rotation of the cranks 820. The crank offsets 828 are rigidly connected to respective cranks 820 and cause motion of the drawbar link 880 to lag about ninety degrees behind motion of its respective foot supporting link 830.

Each flexible rocker 840 cooperates with the frame 810 to define a first pivot axis X1. Each flexible rocker 840 cooperates with a respective bearing member 850 to define a second pivot axis X2 at the point of separation therebetween. Each flexible rocker 840 cooperates with a respective foot supporting link 830 to define a third pivot axis X3. Each intermediate link 835 cooperates with a respective foot supporting link 830 to define a fourth pivot axis X4. Each drawbar link 880 cooperates with a respective intermediate link 835 to define a fifth pivot axis X5 which pivots about a respective fourth pivot axis X4. The drawbar links 880 and the crank offsets 828 cooperate to define a sixth pivot axis X6 which rotates about the crank axis X8. The force receiving members 830 and the cranks 820 cooperate to define another pivot axis X7 which also rotates about the crank axis X8.

Figure 14:
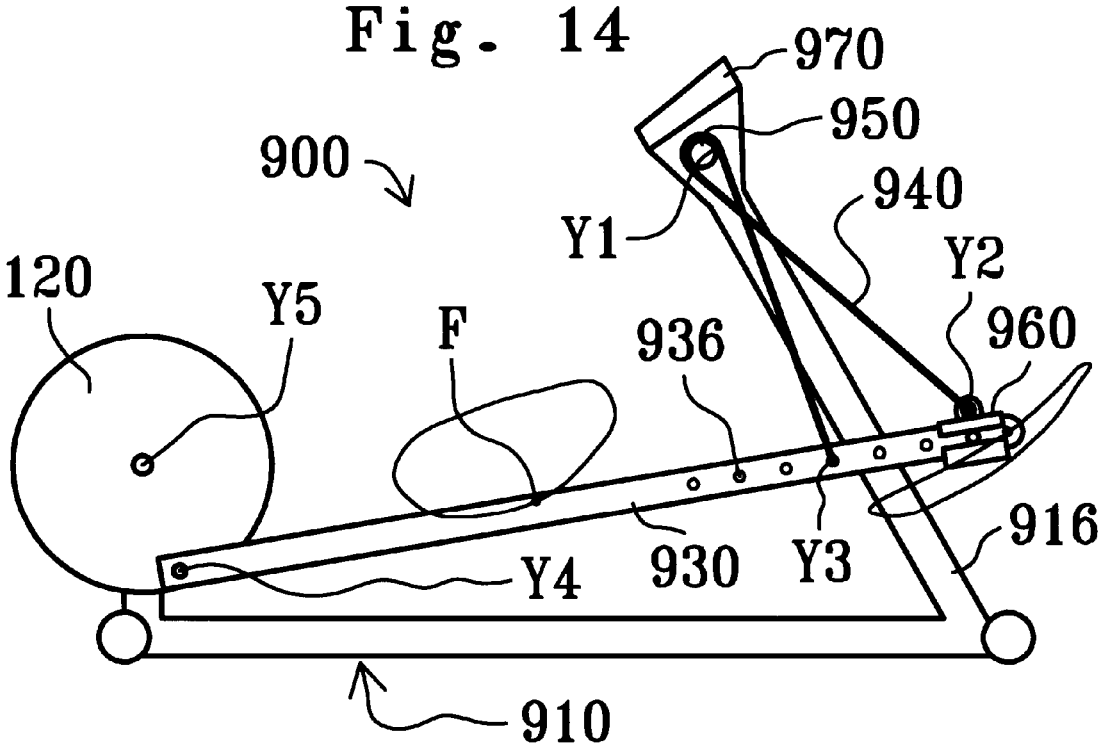
FIG. 14 is a side view of a ninth exercise apparatus constructed according to the principles of the present invention.
Figure 15:
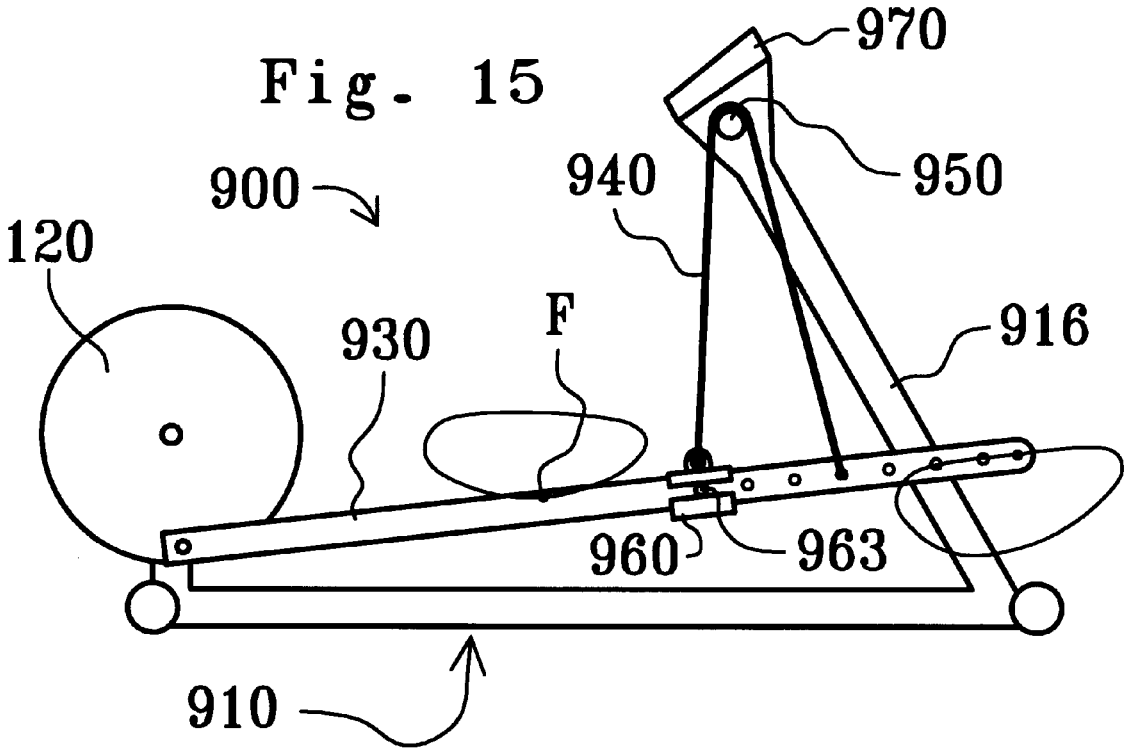
FIG. 15 is a side view of the exercise apparatus of FIG. 14 in a discrete configuration.

A ninth embodiment of the present invention is designated as 900 in FIGS. 14–15. The exercise apparatus 900 includes the same cranks 120 and a frame 910 and foot supporting members 930 similar to those on several preceding embodiments. The forward end of each foot supporting member 930 is rotatably connected to opposite ends of a respective flexible rocker link 940. An intermediate portion of each flexible rocker link 940 is disposed about a pulley 950 supported by the forward stanchion 916 on the frame 910. A user interface 970 is also mounted on the forward stanchion 916 and is in communication with the cranks 120, for example, to provide an indication of exercise intensity.

One of the ends of each flexible rocker link 940 occupies a fixed position relative to its respective foot supporting member 930, and the other end of each flexible rocker link 940 occupies a selectively variable position relative to its respective foot supporting member 930. More specifically, on each side of the apparatus 900, a sleeve or collar 960 is slidably mounted on the foot supporting member 930, and the "movable" end of the flexible rocker link 940 is connected to the collar 960. A pin 963 or other fastener is inserted through a hole in the collar 960 and any of several holes 936 in the foot supporting member 930 to lock the collar 960 in any available position along the foot supporting member 930. A slot is provided in the collar 960 to avoid interference with the other, "fixed" end of the flexible rocker link 940.

The pulleys 950 and respective flexible links 940 cooperate to define a first pivot axis Y1. The flexible links 940 and respective foot supporting links 930 cooperate to define respective second and third pivot axes Y2 and Y3. Each foot supporting link 930 cooperates with a respective crank 120 to define a fourth pivot axis Y4 which rotates about the crank axis Y5.

When the collar 960 occupies the position shown in FIG. 14, the person's foot F and underlying foot supporting link 930 move through the generally elliptical and relatively inclined path shown. When the collar 960 is moved rearward and occupies the position shown in FIG. 15, the person's foot F and underlying foot supporting link 930 move through the generally elliptical and substantially level path shown.

Figure 16:
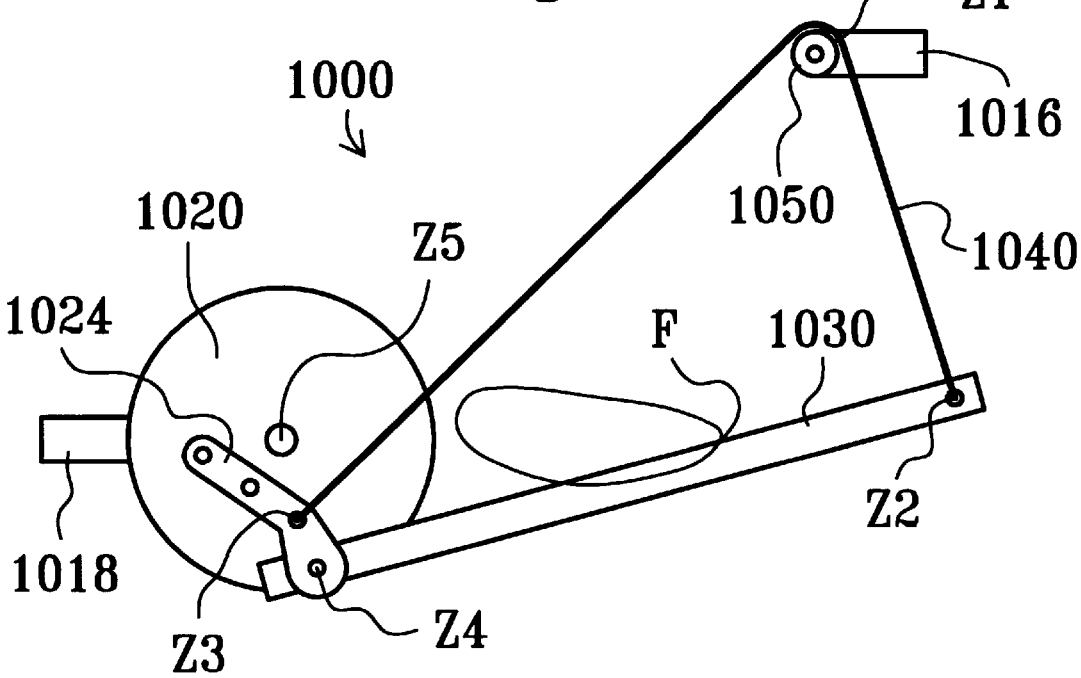
FIG. 16 is a side view of a tenth exercise apparatus constructed according to the principles of the present invention.
Figure 17:
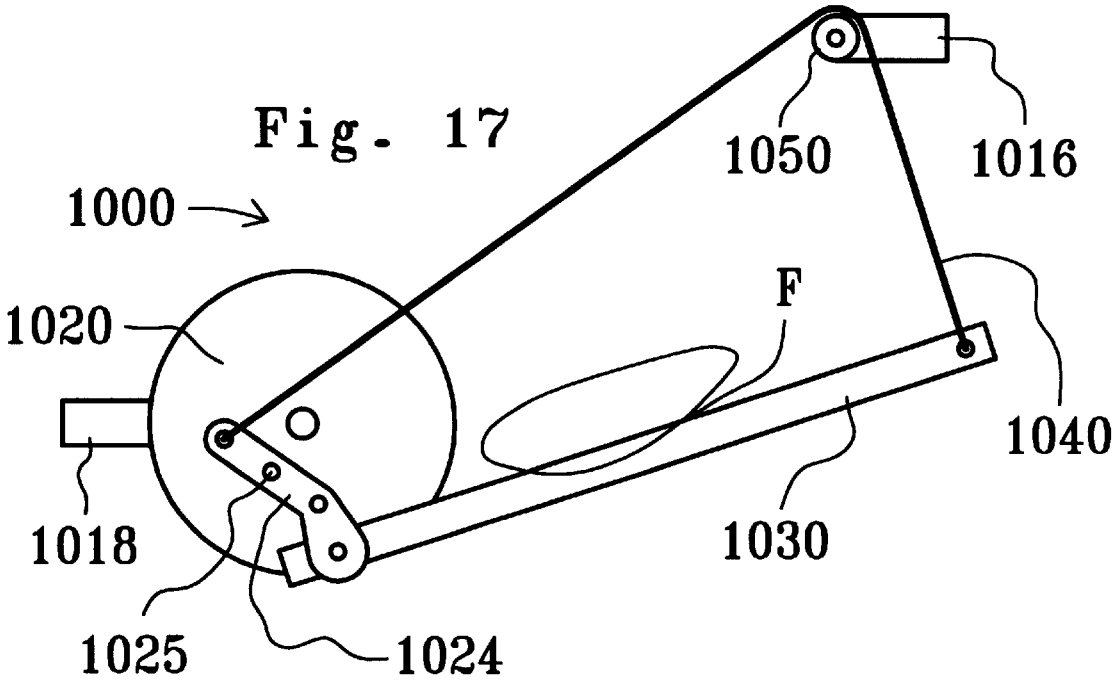
FIG. 17 is a side view of the exercise apparatus of FIG. 16 in a discrete configuration.

A tenth embodiment of the present invention is designated as 1000 in FIGS. 16–17. The exercise apparatus 1000 includes a frame designed to rest upon a floor surface and including forward and rearward frame members designated as 1016 and 1018, respectively. Left and right cranks 1020 are rotatably mounted on opposite sides of the frame member 1018 and rotate as a unit relative thereto. Left and right foot supporting members 1030 have rear ends which are rotatably mounted to respective cranks 1020, and front ends which are supported by respective flexible rocker links 1040.

Left and right crank offsets 1024 are rigidly mounted on respective cranks 1020. Holes 1025 in each of the crank offsets 1024 provide a means for adjustably connecting an end of a respective rocker link 1040 thereto. An opposite end of each rocker link 1040 is rotatably connected to the front end of a respective foot supporting member 1030. An intermediate portion of each rocker link 1040 is routed about a pulley 1050 on the frame member 1016.

The pulleys 1050 and respective flexible links 1040 cooperate to define a first pivot axis Z1. The flexible links 1040 and respective foot supporting links 1030 cooperate to define respective second pivot axes Z2. The flexible links 1040 and respective crank offsets 1024 cooperate to define respective third pivot axes Z3. The foot supporting links 1030 and respective cranks 1020 cooperate to define respective fourth pivot axes Z4 which rotates about the crank axis Z5.

When the flexible rocker links 1040 are arranged as shown in FIG. 16, the person's foot F and underlying foot supporting link 1030 move through the generally elliptical and substantially level path shown. When the rocker links 1040 are arranged as shown in FIG. 17, the person's foot F and underlying foot supporting link 1030 move through the generally elliptical and relatively inclined path shown.

The present invention may also be described in terms of various methods. For example, the first embodiment 100 of the present invention may be made by rotatably connecting a rear end of each foot supporting link to a respective crank, and rotatably connecting a front end of each foot supporting link to a respective flexible rocker link. The method may further involve configuring one or more bearing surfaces to have a specific desired effect on the flexible rocker links. Such an effect may be obtained by adjusting the diameter and/or shape of the bearing surface, for example.

The second embodiment 200 suggests that part of the rocker link may be rigid; the orientation of the bearing surface may be adjusted relative to the frame; the length of the flexible rocker link may be adjusted; and/or the user may be offered the option of carrying or supporting a portion of his bodyweight while exercising. The third embodiment 300 shows a "cammed" bearing surface and also suggests that an adjusting means may be provided to adjust the orientation of the bearing surface and/or the length of the rocker link (either automatically or at the discretion of the user).

The fourth embodiment 400 suggests additional and/or alternative method steps, including selectively moving the pivot point defined between the rocker link and the frame; and/or connecting opposite ends of the rocker link to the foot supporting member and connecting an intermediate portion of the rocker link to the frame. The fifth embodiment 500 suggests that a bearing member may be provided to act upon an intermediate portion of the flexible rocker link; the bearing member may be mounted on the foot supporting member; and/or the position and/or orientation of the bearing member relative to the foot supporting member may be adjusted (either automatically or at the discretion of the user).

The sixth embodiment 600 suggests the provision of multiple bearing members for each flexible rocker link; and/or the provision of one or more "intermediate" bearing members on the frame. The seventh embodiment 700 suggests the provision of multiple "intermediate" bearing members fixed to the foot supporting member; and/or the provision of a linear damper acting upon the foot supporting member.

Still more method steps are suggested by the remaining embodiments. The eighth embodiment 800 uses a crank-driven drawbar link to move an "intermediate" bearing member that is mounted on the foot supporting member; the ninth embodiment 900 adjusts exercise motion by moving a first end of the flexible rocker link relative to the foot supporting member; and the tenth embodiment 1000 routes the rocker link from the foot supporting link about a pulley on the frame to the crank.

The foregoing description sets forth only some of the numerous possible variations and/or embodiments of the present invention. Those skilled in the art will not only recognize additional features but also mix and match features from various embodiments. For example, one such modification would be to form the flexible rocker links with two different materials having different lengths and elasticities when free of stress. The first material would be relatively shorter and more elastic, and the second material would be relatively longer and less elastic. In any event, the scope of the present invention is to be limited only to the extent of the claims which follow.

What is claimed is:

1. An exercise apparatus, comprising:

a frame designed to rest upon a floor surface;

a left crank and a right crank, wherein each said crank is mounted on the frame and rotatable relative thereto about a crank axis;

a left foot supporting member and a right foot supporting member, wherein each said foot supporting member is rigid, and a first portion of each said foot supporting member is movably connected to a respective crank; and a left flexible member and a right flexible member, wherein each said flexible member is connected to the frame, and a second portion of each said foot supporting member is supported by a respective flexible member.

2. The exercise apparatus of claim 1, wherein a third portion of each said foot supporting member, disposed between the first portion and the second portion, is sized and configured to support a person's foot.

3. The exercise apparatus of claim 1, wherein at least one cylindrical member is mounted on the frame, and each said flexible member partially circumscribes the at least one cylindrical member.

4. The exercise apparatus of claim 3, wherein the at least one cylindrical member is selectively rotatable relative to the frame.

5. The exercise apparatus of claim 1, further comprising an adjusting means for adjusting an effective length of each said flexible member interconnected between the frame and the second portion of a respective foot supporting member.

6. The exercise apparatus of claim 5, wherein the adjusting means includes a wheel rotatably mounted on the frame, and an upper end of each said flexible member is secured to the wheel.

7. The exercise apparatus of claim 1, wherein rotation of each said crank causes each said foot supporting member to move each of a person's feet through a substantially elliptical path.

8. The exercise apparatus of claim 1, further comprising at least one interfering member connected to the frame and disposed within a path traversed by an intermediate portion of the flexible member during rotation of the crank.

9. The exercise apparatus of claim 8, wherein the at least one interfering member is selectively movable relative to the frame.

10. The exercise apparatus of claim 8, wherein the at least one interfering member includes an interfering member disposed generally between the flexible member and the crank.

11. The exercise apparatus of claim 8, wherein the at least one interfering member includes an interfering member disposed generally on a side of the flexible member opposite the crank.

12. The exercise apparatus of claim 1, further comprising at least one interfering member disposed within a path traversed by an intermediate portion of the flexible member during rotation of the crank, wherein the at least one interfering member is linked to movement of the foot supporting member.

13. The exercise apparatus of claim 1, further comprising at least one interfering member disposed within a path traversed by an intermediate portion of the flexible member during rotation of the crank, wherein the at least one interfering member is linked to rotation of the crank.

14. The exercise apparatus of claim 1, further comprising at least one interfering member disposed within a path traversed by an intermediate portion of the flexible member during rotation of the crank, wherein the at least one interfering member is linked to both movement of the foot supporting member and rotation of the crank.

15. The exercise apparatus of claim 1, wherein the flexible member has a first end connected to the foot supporting member, a second end connected to the crank, and an intermediate portion support by the frame.

16. The exercise apparatus of claim 13, wherein a juncture defined between the crank and the second end of the flexible member is selectively movable relative to the crank.

17. The exercise apparatus of claim 1, wherein the flexible member has a first end connected to the foot supporting member, a second end connected to the foot supporting member, and an intermediate portion support by the frame.

18. The exercise apparatus of claim 17, wherein the flexible member is routed about more than one pulley on the frame.

19. The exercise apparatus of claim 17, wherein the distance between the first end and the second end is selectively adjustable.

20. An exercise apparatus, comprising:

a frame designed to rest upon a floor surface;

a left crank and a right crank, wherein each said crank is mounted on the frame and rotatable relative thereto about a crank axis;

a left foot supporting member and a right foot supporting member, wherein each said foot supporting member is rigid, and a first portion of each said foot supporting member is movably connected to a respective crank;

a common drum rotatable mounted on the frame; and a left flexible member and a right flexible member, wherein each said flexible member is connected to the common drum, and a second portion of each said foot supporting member is connected to a respective flexible member, and rotation of the common drum relative to the frame adjusts an effective length of each said flexible member.

* * * * *